US007059001B2

(12) United States Patent
Woolfson

(10) Patent No.: US 7,059,001 B2
(45) Date of Patent: Jun. 13, 2006

(54) MATTRESS

(75) Inventor: David Woolfson, Dublin (IE)

(73) Assignee: Lancastria Limited, St. Stephens Green (IE)

( * ) Notice: Subject to any disclaimer, the term of this patent is extended or adjusted under 35 U.S.C. 154(b) by 0 days.

(21) Appl. No.: 10/937,895

(22) Filed: Sep. 10, 2004

(65) Prior Publication Data

US 2005/0188467 A1 Sep. 1, 2005

Related U.S. Application Data

(63) Continuation of application No. 10/640,678, filed on Aug. 14, 2003, now abandoned, which is a continuation of application No. 09/966,053, filed on Oct. 1, 2001, now abandoned.

(30) Foreign Application Priority Data

Sep. 29, 2000 (IE) ..... S2000/0783

(51) Int. Cl.
*A47C 27/14* (2006.01)
*A47C 27/15* (2006.01)

(52) U.S. Cl. ..... 5/740; 5/699; 5/709; 5/724; 5/727

(58) Field of Classification Search ..... 5/740, 5/699, 724, 727, 734, 736, 737, 420, 939, 5/709

See application file for complete search history.

(56) References Cited

U.S. PATENT DOCUMENTS

| | | | | |
|---|---|---|---|---|
| 2,357,789 | A * | 9/1944 | Levy | 5/490 |
| 4,445,241 | A | 5/1984 | Ender et al. | |
| 4,901,387 | A | 2/1990 | Luke | |
| 5,010,609 | A | 4/1991 | Farley | |
| 5,669,094 | A | 9/1997 | Swanson | |
| 5,701,623 | A | 12/1997 | May | |
| 5,836,025 | A | 11/1998 | Poncy, Sr. | |
| 5,960,496 | A | 10/1999 | Boyd | |
| 6,052,851 | A | 4/2000 | Kohnle | |
| 6,269,504 | B1 | 8/2001 | Romano et al. | |
| 6,363,553 | B1 | 4/2002 | Baumgaertel et al. | |

FOREIGN PATENT DOCUMENTS

| | | |
|---|---|---|
| DE | 298 00 506 | 10/1998 |
| EP | 0 777 988 A1 | 6/1997 |
| EP | 0 782 830 A1 | 7/1997 |
| EP | 0 962 171 A1 | 12/1999 |
| GB | 2 244 000 A | 11/1991 |
| GB | 2 290 256 A | 12/1995 |
| WO | WO 01/05279 A1 | 1/2001 |

* cited by examiner

*Primary Examiner*—Alexander Grosz
(74) *Attorney, Agent, or Firm*—Birch, Stewart, Kolasch, & Birch, LLP

(57) ABSTRACT

A mattress comprises a sealed outer casing within which is mounted a resilient support formed by a composite foam core. At least an upper portion of the resilient support is formed by a visco-elastic foam. A vent is provided in a side wall of the casing and is covered by a filter which prevents ingress of bacteria into the cover. A flap is mounted on the cover and in use extends down over the vent to prevent the filter being damaged by fluids.

11 Claims, 3 Drawing Sheets

MATTRESS

This application is a Continuation of application Ser. No. 10/640,678, filed on Aug. 14, 2003, now abandoned which is a Continuation of application Ser. No. 09/966,053 filed on Oct. 1, 2001, now abandoned and for which priority is claimed under 35 U.S.C. § 120; and this application claims priority of application Ser. No. S2000/0783 filed in Ireland on Sep. 29, 2000 under 35 U.S.C. § 119; the entire contents of all are hereby incorporated by reference.

BACKGROUND OF THE INVENTION

The invention is particularly related to a mattress which is suitable for use in medical applications for the improved comfort of patients who are confined to bed for long periods of time. Such patients often suffer from bedsores due to the concentration of pressure in regions where the patient's body touches the mattress, particularly in the regions of the shoulders, hips and heels. Another problem arising in medical environments is the possibility of infection of the mattress with bacteria which could subsequently infect a patient.

The present invention is directed towards overcoming these problems.

SUMMARY OF THE INVENTION

According to the invention there is provided a mattress, comprising an outer casing within which is mounted a resilient support, wherein the support is sealed within the casing and said casing has an air vent in a side wall of the casing. Thus, conveniently the casing can be formed with welded seams without ballooning of the casing. Further, the vent allows the mattress to breathe.

In a particularly preferred embodiment at least an upper portion of the resilient support is formed by a visco-elastic foam. Advantageously the viscoelastic slow foam or memory foam has a tendency to mould itself into the shape of the body lying on the foam layer, thus providing an even distribution of pressure over the body of the patent and thus minimising localised high pressure points.

In a preferred embodiment, a filter is mounted across the air vent to prevent the ingress of bacteria to an interior of the casing.

In another embodiment the filter has pores for through-passage of air, said pores being sized to trap any particle greater than 1 micron in size. As bacteria typically attaches to particles over 6 microns in size and the filter blocks the passage of any particle greater than 1 micron in size, the filter effectively prevents ingress of bacteria into the cover.

In a further embodiment a flap is mounted on the cover, the flap being fixed to an exterior of the cover above the vent and extending downwardly over the vent. This advantageously protects the vent and filter being damaged by fluid such as when cleaning the mattress for example.

The cover is preferably of an elastic material which is stretched over the foam core. Additional anti-bacterial, fungistatic protection may be provided for the foam core and for the cover if desired.

In a preferred embodiment of the invention at least portion of the foam layer has a profiled area comprising projections and hollows at an upper support surface of the foam layer.

In a particularly preferred embodiment said profiled area is at a lower end of the foam layer forming a heel support region of the foam layer. This advantageously provides extra pressure reduction in the heel area of a patient when the mattress is in use.

In another embodiment the projections are of generally flat-topped pyramid shape arranged in a chequered formation with hollows formed therebetween.

In another embodiment the visco-elastic foam has a density in the range 60–95 kg/m$^3$. Most preferably the density of the visco-elastic foam is 85 kg/m$^3$.

In a particularly preferred embodiment, the support is provided by a multi-layered support core comprising the viscoelastic foam top layer mounted on at least one bottom layer of foam having a greater resilience than the visco-elastic foam. This provides added rigidity and support to the core.

In a particularly preferred embodiment, the bottom layer comprises a combustion modified high resilient foam.

Preferably the casing is of a stretchable elastic material.

In another embodiment the resilient support further includes an outer frame mounted about a side of said layers forming an endless side margin about said layers, said outer frame being formed of a high index foam.

In a particularly preferred embodiment the mattress includes a composite resilient support having a laminated core with a rectangular bottom layer and an associated rectangular top layer superimposed on said bottom layer, a top face of the bottom layer engaging and adhesively secured to a complementary bottom face of the top layer, said bottom layer being formed of a combustion modified high resilience foam and said top layer being formed of a visco-elastic foam, said layers being of equal depth, said core being encircled by an outer frame formed of a high index foam which extends about the side faces and end faces of the core and being adhesively secured thereto, a sealed casing mounted about said core, said casing being formed of an elastic material stretched about the core with overlapping seams of the core being welded together to form a sealed enclosure about the core, an opening in said casing forming a vent to allow air passage between an interior and an exterior of the casing, a filter mounted across the vent and a flap mounted on the casing covering the vent and being fixed to said casing about a periphery of the flap above and at each side of the vent leaving a downwardly facing opening between a lower end of the flap and the casing for air passage to and from the air vent.

In another aspect the invention provides a mattress comprising an outer casing within which is mounted a resilient support, at least an upper portion of the support being formed by a layer of visco-elastic foam, the support having lower end forming a heel support region of the support, an upper surface of said heel support region being a profiled area of projections and hollows. Preferably the projections have a flat-topped pyramid shape.

In another embodiment the support is sealed within the casing and said casing has an air vent in a sidewall of the casing. Ideally a filter is mounted across the air vent to prevent ingress of bacteria to an interior of the casing. Preferably a flap is mounted onto the casing, the flap being fixed to an exterior of the casing above the vent and extending downwardly over the vent, a free edge of the flap defining with the casing an opening for through passage of air to and from the vent.

In a further aspect the invention provides a mattress comprising an elastic outer casing within which is mounted a resilient support, at least an upper portion of the support being formed by a layer of visco-elastic foam having a density of about 85 kg/m$^3$.

In another embodiment the resilient support has a laminated construction including a rectangular bottom layer and an associated rectangular top layer superimposed on said bottom layer, a top face of the bottom layer engaging and being adhesively secured to a complementary bottom face of the top layer, said bottom layer being formed of a combustion modified high resilience foam and said top layer being formed by the layer of visco-elastic foam.

BRIEF DESCRIPTION OF THE DRAWINGS

The invention will be more clearly understood from the following description of some embodiments thereof, given by way of example only, with reference to the accompanying drawings, in which.

DETAILED DESCRIPTION OF THE PREFERRED EMBODIMENTS

Figure 1:
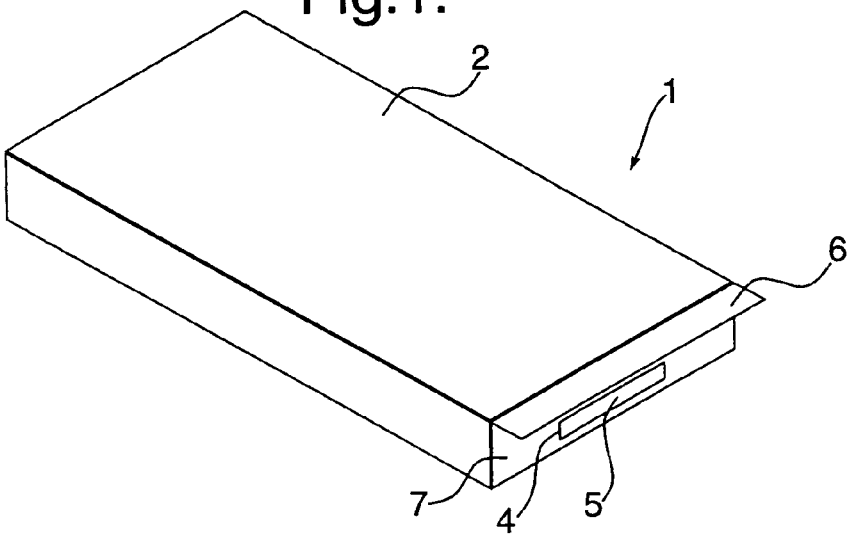
FIG. 1 is a perspective view of a mattress according to the invention.
Figure 2:
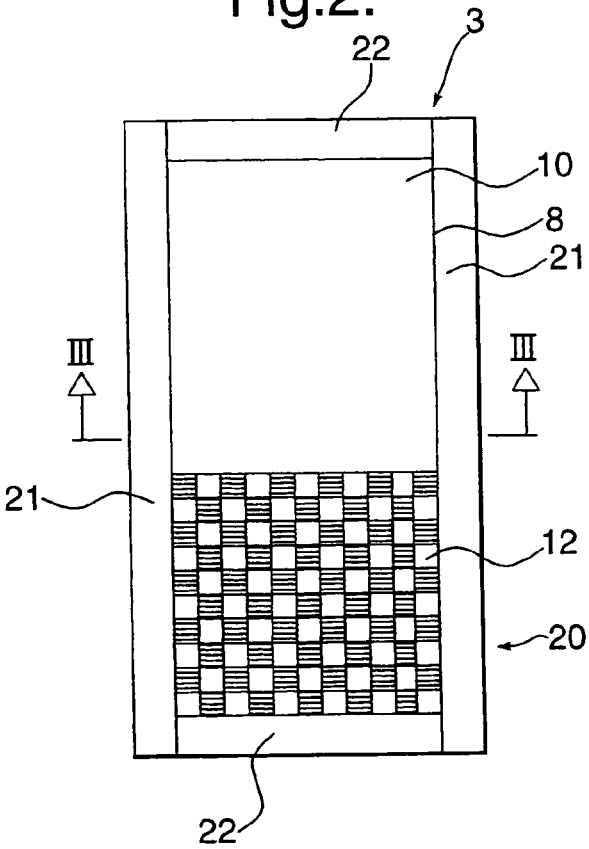
FIG. 2 is a plan view of a composite foam core of the mattress.
Figure 3:
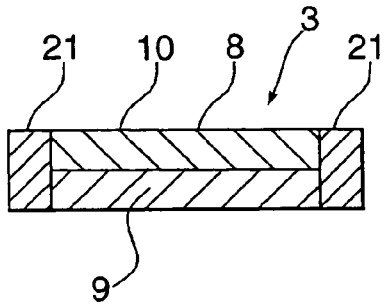
FIG. 3 is a sectional view taken along the line III—III of FIG. 2.
Figure 4:
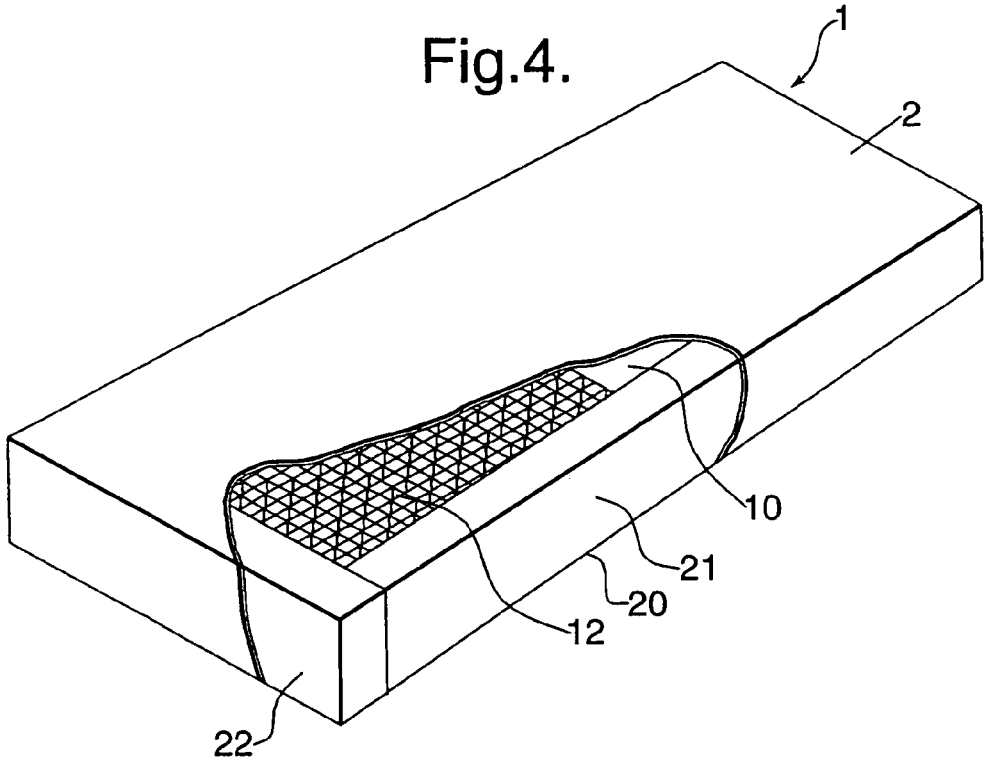
FIG. 4 is a perspective, partially cut-away view illustrating the mattress.
Figure 5:
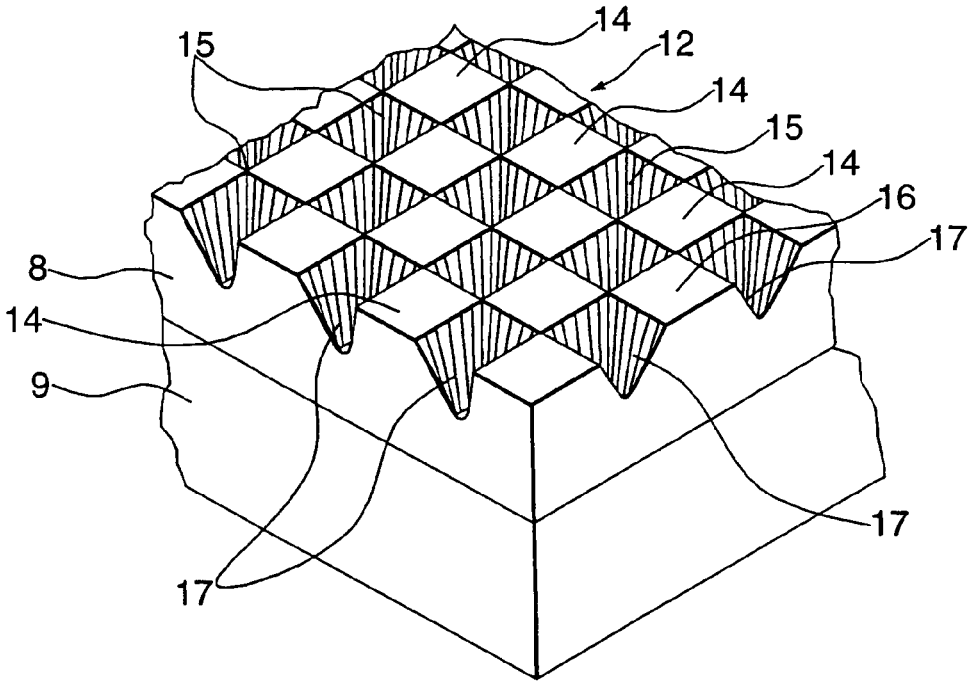
FIG. 5 is a detail perspective view illustrating a profiled pressure reducing portion of the core.

Referring to the drawings, and initially to FIGS. 1 to 5 thereof, there is illustrated a mattress according to the invention indicated generally by the reference numeral 1. The mattress 1 comprises a sealed outer casing 2 within which is mounted a resilient support formed by a composite foam core 3. A vent 4 is provided in a side wall 7 of the casing 2 and is covered by a filter 5, which prevents ingress of bacteria into the cover 2. A flap 6 is mounted on the cover 2 and in use extends down over the vent 4 to prevent the filter 5 being damaged by fluids. The flap 6 is attached to the cover 2 along top and side edges leaving at least portion of the bottom edge open to allow air passage.

The cover 2 is formed of an elastic stretchable material with seams of the cover 2 being welded to provide a sealed enclosure for the core 3.

The foam core 3 comprises an upper layer 8 of a visco-elastic material mounted on and adhesively secured to a lower layer 9 which comprises a combustion modified high resilience foam. The upper layer 8 has a top surface 10 upon which a patient is supported in use.

A lower end of the upper layer has an anatomic profiling region 12 in which material has been removed from the layer 8 to provide a serious of projections 14 and associated hollows 15 arranged in a chequered configuration. The projections 14 have a generally pyramidal shape having a square flat top 16 which is substantially flush with the continuous portion of top surface 10 at an upper end of the upper layers. Side walls 17 slope downwardly and outwardly of each side of the top 16 defining hollows 15 or voids between the projections 14. In this case the hollows 15 extend roughly one half of the depth of the upper layer 8. The depth of both layers 8, 9 is typically about 7 cm. The upper visco-elastic foam layer 8 has a density of 85 kg/m$^3$.

For added support to the core 3 an outer frame 20 is provided comprising side pieces 21 glued to each side of the layers 8, 9 and end pieces 22 glued across the ends of the layers 8, 9. The frame 20 is formed from a high index foam material.

In use, the mattress 1 is mounted on a bed with the upper layer 8 of visco-elastic foam uppermost When a patient lies on the mattress 1 the upper layer 8 tends to deform to closely conform to the contour of the patient's body to gently support and evenly distribute the weight of the patient over a wide area. Further, the profiled region 12 on which the patient's heels rest provides extra pressure reduction in the heel area to reduce the risk of pressure sore development in this area of the body.

The flap which covers the filter and vent does not have to extend fully across the side of the casing and may simply extend over the vent and filter.

It will be noted that the cover can be easily cleaned. Further, as the cover 2 is sealed bacteria cannot impregnate the mattress. The vent and filter allows the mattress to breathe when a person lies on or gets up from the mattress and prevents ballooning of the sealed casing.

It will be appreciated that all the foams used are treated so that they are flame retardant to British Standard SI 1324.

Figure 6:
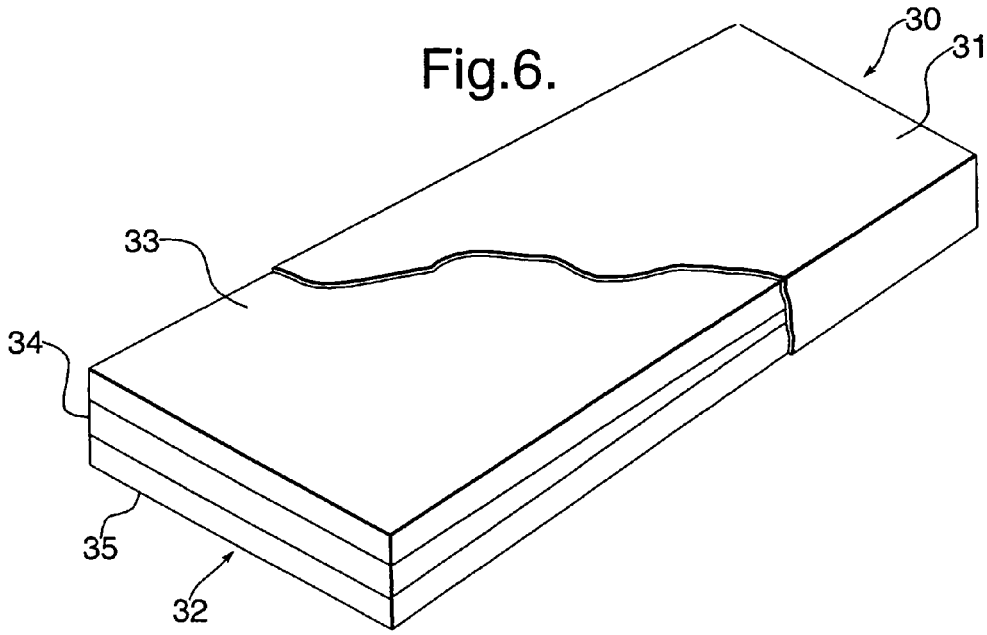
FIG. 6 is a perspective view of another mattress.

Referring now to FIG. 6, there is shown another mattress 30 comprising an outer cover 31 surrounding a foam support core 32 formed by three layers of foam material comprising an upper layer 33 of visco-elastic foam, an intermediate layer 34 and a lower layer 35 of foams of greater resilience than the visco-elastic foam.

Figure 7:
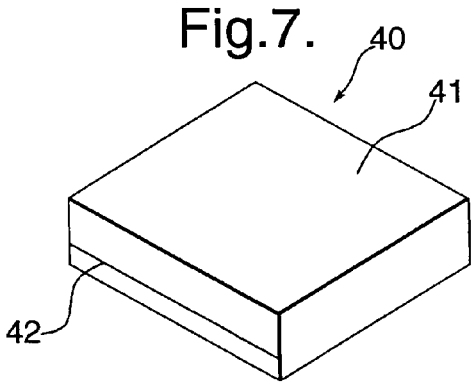
FIG. 7 is a perspective view of a cushion according to another embodiment of the invention.
Figure 8:
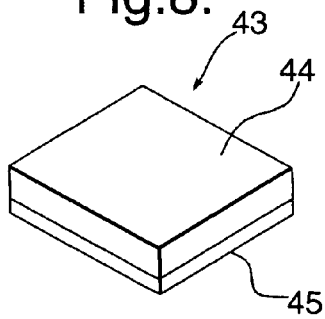
FIG. 8 is a perspective view of a foam core of the cushion of FIG. 7.

The term "mattress" as used in this patent specification can also be taken to include cushions of similar construction. For example, referring to FIGS. 7 and 8, there is shown a cushion 40 according to another embodiment of the invention. The cushion 40 comprises an outer cover 41 having an opening closed by a concealed zip 42 along one edge, within which is mounted a foam support core 43. The foam core 43 comprises an upper layer 44 of visco-elastic foam and a lower layer 45 of a combustion modified high resilience foam.

The invention is not limited to the embodiments hereinbefore described, but may be varied in both construction and detail within the scope of the appended claims.

The invention claimed is:

1. A mattress comprising:

an outer casing within which is mounted a resilient support, said support being sealed within the casing, and said casing having an air vent in a side wall of the casing, wherein:

said support is a composite resilient support having a laminated core with a rectangular bottom layer and an associated rectangular top layer superimposed on said bottom layer, a top face of the bottom layer is engaged and adhesively secured to a complementary bottom face of the top layer, said bottom layer is formed of a combustion modified high resilience foam and said top layer is formed of a visco-elastic foam, said top and bottom layers are of equal depth, said laminated core is encircled by an outer frame formed of a high index foam which extends about side faces and end faces of the laminated core and is adhesively secured thereto, a sealed casing mounted about said laminated core, said casing being formed of an elastic material stretched about the laminated core with overlapping seams of the casing being secured together to form a sealed enclosure about the laminated core, an opening in said casing forms a vent to allow air passage between an interior and an exterior of the casing, a filter is mounted across the vent, and a flap is mounted on the casing covering the vent and is fixed to said casing about a periphery of the flap above and at each side of the vent leaving a downwardly facing opening between a lower end of the flap and the casing for air passage to and from the air vent.

2. The mattress as claimed in claim 1, wherein the filter is mounted across the air vent to prevent the ingress of bacteria to an interior of the casing.

3. The mattress as claimed in claim 2, wherein the filter has pores for through-passage of air, said pores being sized to trap any particle greater than 1 micron in size.

4. The mattress as claimed in claim 1, wherein at least portion of the resilient support has a profiled area comprising projections and hollows at an upper surface of the resilient support.

5. The mattress as claimed in claim 4, wherein said projections have a flat-topped pyramid shape.

6. The mattress as claimed in claim 4, wherein said profiled area is at a lower end of the resilient support forming a heel support region of the resilient support.

7. The mattress as claimed in claim 1, wherein the visco-elastic foam has a density in the range 60–95 kg/m$^3$.

8. The mattress as claimed in claim 7, wherein the density of the visco-elastic foam is about 85 kg/m$^3$.

9. A mattress comprising:

an outer casing within which is mounted a resilient support, at least an upper portion of the support being formed by a layer of visco-elastic foam, wherein:

the support has a lower end forming a heel support region of the support, an upper surface of said heel support region is a profiled area of projections and hollows, the support is sealed within the casing and said casing has an air vent in a side wall of the casing, a filter is mounted across the air vent to prevent ingress of bacteria to an interior of the casing, and the filter has pores for through-passage of air, said pores being sized to trap any particle greater than 1 micron in size.

10. The mattress as claimed in claim 9, wherein the projections have a flat-topped pyramid shape.

11. A mattress comprising:

an outer casing within which is mounted a resilient support, at least an upper portion of the support being formed by a layer of visco-elastic foam, wherein:

the support has a lower end forming a heel support region of the support, an upper surface of said heel support region is a profiled area of projections and hollows, the support is sealed within the casing and said casing has an air vent in a side wall of the casing, a filter is mounted across the air vent to prevent ingress of bacteria to an interior of the casing, and the filter has pores for through-passage of air, said pores being sized to trap any particle. greater than 1 micron in size, a flap is mounted on the casing, the flap being fixed to an exterior of the casing above the vent and extending downwardly over the vent, a free edge of the flap defining with the casing an opening for through-passage of air to and from the vent.

* * * * *